US007984765B2

(12) United States Patent
Askeland

(10) Patent No.: US 7,984,765 B2
(45) Date of Patent: Jul. 26, 2011

(54) SYSTEM AND METHOD FOR WELL INTERVENTION

(75) Inventor: Tom Kjetil Askeland, Straume (NO)

(73) Assignee: Well Intervention Solutions AS, Straume (NO)

( * ) Notice: Subject to any disclaimer, the term of this patent is extended or adjusted under 35 U.S.C. 154(b) by 652 days.

(21) Appl. No.: 11/884,376

(22) PCT Filed: Feb. 15, 2006

(86) PCT No.: PCT/NO2006/000060

§ 371 (c)(1),
(2), (4) Date: Feb. 7, 2008

(87) PCT Pub. No.: WO2006/088372

PCT Pub. Date: Aug. 24, 2006

(65) Prior Publication Data

US 2008/0230228 A1 Sep. 25, 2008

(30) Foreign Application Priority Data

Feb. 15, 2005 (NO) ..... 20050809

(51) Int. Cl.
*E21B 23/00* (2006.01)

(52) U.S. Cl. ..... 166/339; 166/336; 166/344; 166/347; 166/351; 166/352; 166/250.01; 166/373; 175/7

(58) Field of Classification Search ..... 175/5–10; 166/336, 338, 339, 341, 344, 346, 347, 351, 166/352, 368, 250.01, 268, 373, 381
See application file for complete search history.

(56) References Cited

U.S. PATENT DOCUMENTS 3,556,209 A * 1/1971 Reistle et al. ..... 166/352
4,149,603 A * 4/1979 Arnold ..... 175/7
(Continued)

FOREIGN PATENT DOCUMENTS

GB 2313610 A1 3/1997
(Continued)

OTHER PUBLICATIONS

International Preliminary Report on Patentability dated Jun. 13, 2007 for International Application No. PCT/NO2006/000060.

(Continued)

*Primary Examiner* — Thomas A Beach
*Assistant Examiner* — Matthew R Buck
(74) *Attorney, Agent, or Firm* — Kilpatrick Townsend Stockton LLP

(57) ABSTRACT

A system and method is described for well intervention in subsea installed oil and gas wells, comprising a surface vessel (10), or rig, with equipment (22) for handling and controlling a connection string (20) for downhole tools, and also a system (26) for the supply and return of drilling fluid, from where the connection string (20) for the downhole tool runs down in an actual drilling hole (36) of a well on the subsea, where a X-mas tree (12) with associated blowout preventer (16) is arranged on the well, and where a return line (24) for drilling fluid runs up to said system (26) on the surface vessel or the rig. The connecting string (20) for downhole tools runs into the well through open sea without a riser or landing string being fitted, and a removable intervention valve (14) is arranged in the drilling hole (36), where the intervention valve is arranged to function as a testable, temporary barrier.

17 Claims, 4 Drawing Sheets

U.S. PATENT DOCUMENTS

| | | | | |
|---|---|---|---|---|
| 4,331,203 | A * | 5/1982 | Kiefer | 166/339 |
| 4,825,953 | A * | 5/1989 | Wong et al. | 166/338 |
| 5,857,523 | A * | 1/1999 | Edwards | 166/374 |
| 6,056,055 | A * | 5/2000 | Falconer et al. | 166/297 |
| 6,386,290 | B1 * | 5/2002 | Headworth | 166/346 |
| 6,415,877 | B1 * | 7/2002 | Fincher et al. | 175/5 |
| 6,510,900 | B2 * | 1/2003 | Dallas | 166/384 |
| 6,591,913 | B2 * | 7/2003 | Reaux et al. | 166/352 |
| 6,648,081 | B2 * | 11/2003 | Fincher et al. | 175/25 |
| 6,691,775 | B2 * | 2/2004 | Headworth | 166/77.2 |
| 6,745,840 | B2 * | 6/2004 | Headworth | 166/346 |
| 6,827,147 | B2 * | 12/2004 | Dallas | 166/379 |
| 6,834,724 | B2 * | 12/2004 | Headworth | 166/384 |
| 6,843,321 | B2 * | 1/2005 | Carlsen | 166/355 |
| 6,854,532 | B2 * | 2/2005 | Fincher et al. | 175/5 |
| 7,163,064 | B2 * | 1/2007 | Moncus et al. | 166/379 |
| 7,219,737 | B2 * | 5/2007 | Kelly et al. | 166/339 |
| 7,264,058 | B2 * | 9/2007 | Fossli | 166/367 |
| 7,325,616 | B2 * | 2/2008 | Lopez de Cardenas et al. | 166/313 |
| 7,380,609 | B2 * | 6/2008 | Page et al. | 166/387 |
| 7,387,165 | B2 * | 6/2008 | Lopez de Cardenas et al. | 166/313 |
| 7,431,092 | B2 * | 10/2008 | Haheim et al. | 166/343 |
| 2004/0031622 | A1 * | 2/2004 | Butler et al. | 175/5 |

FOREIGN PATENT DOCUMENTS

| | | | |
|---|---|---|---|
| GB | 2326892 | A | 6/1999 |
| WO | WO 96/00835 | A1 | 1/1996 |
| WO | WO 02/20938 | A1 | 3/2002 |
| WO | WO 2004/003338 | A1 | 1/2004 |

OTHER PUBLICATIONS

Written Opinion of the International Preliminary Examining Authority dated Apr. 30, 2007 for International Application No. PCT/NO2006/000060.

International Search Report dated Oct. 5, 2006 for International Application No. PCT/NO2006/000060.

* cited by examiner

SYSTEM AND METHOD FOR WELL INTERVENTION

The present invention relates to a system and a method for well intervention in subsea installed water- or hydrocarbon producing wells, comprising a surface vessel or rig, with equipment to handle and control a connection string for downhole tools, and also a system for supply of and return of drilling fluid, from which the connection string for the downhole tool runs down into a drilling hole on the subsea through open sea without a riser or landing string being fitted, where a X-mas tree with an associated blow out preventer is arranged on the well, and where a return line for drilling fluid runs up to said system on the surface vessel or the rig.

The invention is related to a system and a method that makes it possible to intervene in subsea installed water- or hydrocarbon producing wells without having to use a riser connection to the surface vessel or device. The system and method cover work in subsea installed water- or hydrocarbon producing wells carried out with the help of a drill pipe, coiled tubing or wireline operations (both braided and slickline), and also said methods based on use of new composite and thermoplastic materials and complimentary solutions. The system and method also make it possible for longer tool strings to be used with a much reduced height of the intervention system, and then especially the length of the sluicing-in pipe.

Today's methods to carry out well interventions in subsea installed wells with the help of a drill pipe or coiled tubing are based on the use of a riser connection between the well head and the surface equipment on the surface vessel or the device. This requires a large, and thus costly, surface vessel or device, which must have room for blow-out preventer valves (BOP) for a riser, and also other equipment that is required for pressure control fluid treatment and stand-by handling. The fact that pressurised well fluid is led directly to the vessel or the device via the riser leads to regulatory demands, which in turn can lead to a more expensive vessel or device. Today however, there are systems that make riserless drilling of top section in oil wells and gas wells possible. These systems are based on controlling the well pressure and removing cuttings/drilling fluid by using a pump solution connected to the device. Return of drilling fluid and any cuttings occur via a flexible return solution.

There are systems and methods today that make riserless wireline operations possible on subsea based wells with the help of an underwater sluice pipe system. The existing systems are based on placing a blowout preventer on top of the existing X-mas tree of the well. On top of the blow-out preventer, one or more sluice pipe lengths are placed which are used to sluice the tool string when it shall enter or come out of the well. A sealing mechanism that seals round the wireline when it is driven into the well is placed on the top.

One of the challenges of the existing underwater sluice pipe systems is the limitation of the system with respect to the length of the tool string which can be driven. The limitation is based on available sluice pipe length which in turn is limited by several factors, not to transfer too much power to the permanent underwater subsea installation. The limitation in length of the tool string leads to several wireline operations having to be carried out in the well to achieve the operation's goal, which in turn leads to a longer and thus more expensive system.

In the main, there are two different systems available today. One system flushes the hydrocarbons from the intervention system, i.e. the temporary equipment used for the intervention, back into the well on the subsea and the second flushes the hydrocarbons back to the surface vessel or the device. The advantage of flushing the hydrocarbons from the intervention equipment back into the well on the subsea, is that one does not have to lead hydrocarbons to a surface vessel or device, something which can reduce the requirements of the vessel or device, lower the risk and thus achieve a cheaper operation.

Systems and methods for well intervention in subsea installed wells from a vessel or the like on the ocean surface, without the use of a riser, are known from U.S. Pat. No. 6,415,877 and U.S. Pat. No. 6,386,290, comprising equipment for handling and controlling a connection string for downhole tools and also a system for supply of and return of drilling fluid, where a X-mas tree and a blow-out preventer are arranged on the well, and a return line for drilling fluid that runs up to the ocean surface vessel.

WO A1 02/20938 describes a system for well intervention, where a coiled tubing unit with driving-in equipment is placed on a blow out preventer on an underwater wellhead.

None of these solutions mentioned describe use of a removable intervention valve in the drill pipe which is arranged to function as a testable, temporary barrier for sluicing-in purposes.

The present invention aims to make possible the carrying out of a more flexible and less expensive well intervention by combining existing and new technology with new methods and systems.

The system with associated methods has, in the main, four principal configurations, i.e. system and method for drilling operations in subsea based wells with a drill pipe or coiled tubing, from a vessel or device, without the use of a riser, and also a system and method for intervention in a well with a coiled tubing or wireline in subsea based water- or hydrocarbon producing wells, from a vessel or device, without the use of a riser.

A preferred embodiment of the system according to the invention is characterised by the characteristic part of the independent claim 1, in that a removable intervention valve is arranged in the drilling hole/production pipe, where the intervention valve is set up to function as a testable, temporary barrier.

Alternative preferred embodiments of the system are characterised by the dependent claims 2-6. The intervention valve is preferably a collectable and regulated/controlled valve for sluicing-in purposes, and the valve can be closed to close off the well and be opened to drive through downhole tools in the well.

In connection with drilling operations with a drill pipe or coiled tubing, a drilling fluid return system is preferably arranged on the top of the blowout preventer, through which the connection string for the downhole tools are led, and said return line runs from there and up to the system for supply and return of drilling fluid.

In connection with coiled tubing operations or wireline operations in water- or hydrocarbon producing wells, a sluicing device, such as one or more sluice pipes with a seal between coiled tubing or wireline, is preferably arranged on the top of the blowout preventer, through which the connection string for the downhole tool is led, and said return line runs from there and up to the system for supply and possibly return of fluid.

Adjoining the sluice device, a coiled tubing injector or a cable injector can be arranged, and the surface vessel or the rig, can comprise a coiled tubing unit or a wireline unit and/or a coiled tubing injector or a cable injector.

A preferred embodiment of the method is characterised by the independent claim 7, in that before the connecting string is led into the well, the drilling hole/production pipe is closed, whereupon a removable intervention valve is installed in the drilling hole/production pipe, where the intervention valve is set up to function as a testable, temporary barrier which makes it possible for the drilling hole to be used as a sluice for the downhole tool that shall go into the well, and to open the intervention valve to let through the connection string with the downhole tool that shall be used in the well.

Preferred alternative embodiments of the method are characterised by the dependent claims 8-18. The intervention valve is preferably installed at a depth in the drilling hole/production pipe which satisfies the requirements for length of well tools and any length for stand-by operational tools (fishing). Before the intervention valve is opened to let through the downhole tool, the valve is tested and verified as a temporary well barrier, and that any well fluid, such as hydrocarbons and/or gas, is flushed out of the intervention equipment. Control of well pressure and well fluid can be carried out by using a drilling fluid return system in combination with complimentary valves.

In connection with drilling operations in subsea based wells with a drill pipe or a coiled tubing, the well is preferably killed first with a suitable killing fluid that is pumped into the well, when the wellhead pressure has been established at the same level as the surrounding pressure, and the well is verified to be without pressure and stable in relation to the surrounding pressure (dead), the drill pipe or coiled tubing with the necessary downhole equipment is lowered down into the well, where the drilling fluid return system takes care of the pressure control during the drilling operation and also transports drilling fluid to the surface vessel or rig.

In connection with completion, the drilling fluid return system can be driven to the well for change of drilling fluid to diesel or a similar fluid that does not keep control of the well pressure, and a safety valve which closes the system can be fitted between vessel and return system for drilling fluid.

In connection with drilling operations with coiled tubings in subsea based wells, an underwater coil pipe injector or well tractor can be used to provide the necessary force to the drilling tool, a coiled tubing injector on the surface can be used to pull up the coiled tubing up from the underwater injector head, possibly to pull the coiled tubing with well tractor and well tool out of the well.

In connection with coiled tubing operations in water- and hydrocarbon producing subsea based wells, the coiled tubing is preferably pulled out of the well after the downhole operation has been completed, until it is above the temporary, regulated/controlled injection valve, thereafter the valve can be closed, necessary tests be carried out and the hydrocarbons be flushed out of the area and the equipment above the intervention valve, before the intervention tool and coiled tubing are brought up. The sequence is repeated as many times as necessary to achieve the objective of the intervention.

In connection with wireline operations in water- and hydrocarbon producing subsea based wells, the tool string is preferably lowered, during the invention, as well as any well tractor, with the help of a wireline winch on the surface and when the deviation in the well is so large that the tool does not go further down due to gravity, the well tractor can be brought in, whereupon the well tractor pushes the tool and pulls the wireline until the required depth has been reached.

After the downhole operation has been completed, the wireline is pulled out of the well until it is above the temporary, controlled intervention valve, thereafter the valve can be closed, the necessary tests be carried out and the hydrocarbons be flushed out of the area and the equipment above the intervention valve, whereupon the intervention tools and wireline are brought up. The sequence is repeated as many times as necessary to achieve the purpose of the intervention.

In connection with intervention in water- or hydrocarbon producing subsea based wells with wireline or coiled tubing, well fluids and gas between the intervention valve and X-mas tree of the well are preferably flushed/forced out of the area with the help of pumping-in inhibitory fluid with substantially higher specific gravity than the well fluids, at the same time as pressure is released from the limited area as high up as possible to avoid too high pressure and also to flush out well fluids and gases.

Well fluids and gases between the intervention valve and the X-mas tree of the well can be forced out of the area by letting the inhibitory fluid sink down toward the intervention valve and replace the well fluid and gases from the intervention valve and up toward the dedicated outlet in the X-mas tree or in dedicated outlets in other parts of the intervention equipment, i.e. the temporary equipment used for the intervention, until all well fluid and gases are out of the production pipe, whereupon the flushing and circulation system of the intervention system can carry out the rest of the flushing out.

The invention shall now be described in more detail, with reference to the enclosed figures, in which.

Figure 4C:
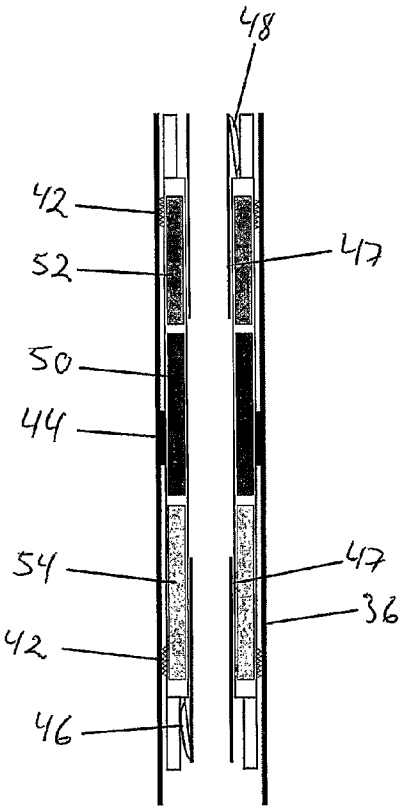
Figure 4B:
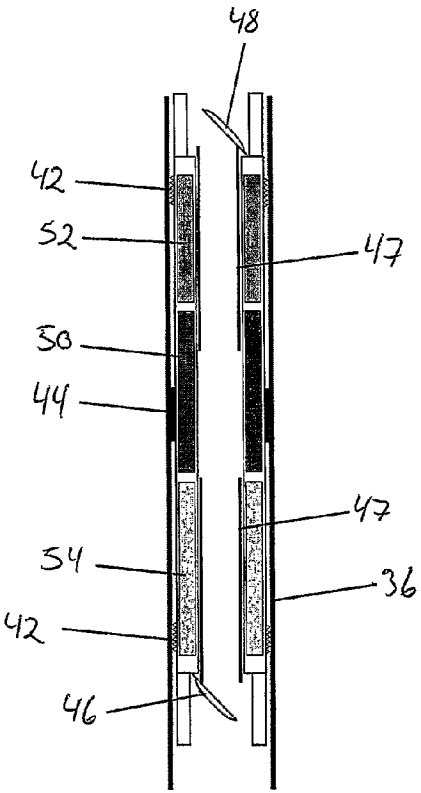
Figure 4A:
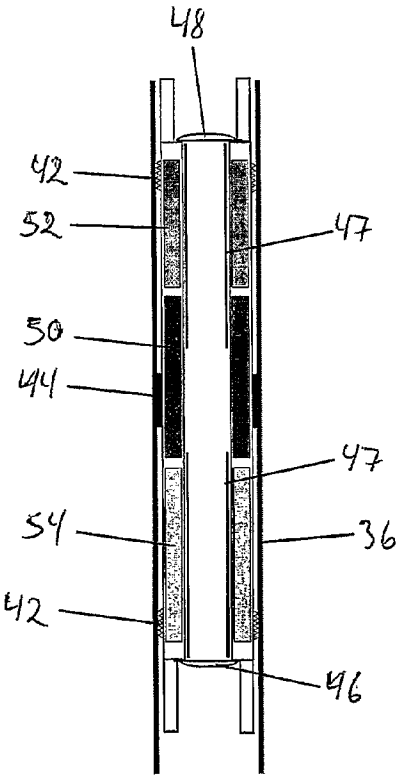

FIGS. 4*a*-4*c* shows an example of an intervention valve to be used in the present invention, in a closed, half-open and open position, respectively.

In the following description, components such as drill pipe, coiled tubing, wireline, etc., have been given the same reference numbers, i.e. all are referred to with reference number 20. Common features of said components are that they function as a connection between downhole tools and equipment on a surface vessel or rig, and said drill pipe, coiled tubing, wireline etc., can thereby also be collectively described as a connection string for the downhole tool. Correspondingly, equipment for handling of said components has been given the same reference number, but it must be understood by a person skilled in the art that this equipment can be different dependent on whether it is a drill pipe, coiled tubing, wireline etc., that shall be handled. With the expression downhole tool, one must understand different tools for the operation in a well, i.e. equipment for drilling operations, intervention equipment, equipment for logging, measuring, fishing, etc.

In the following, different embodiment examples shall be described, but it must be understood that other configurations are possible within the framework of the invention.

Figure 1:
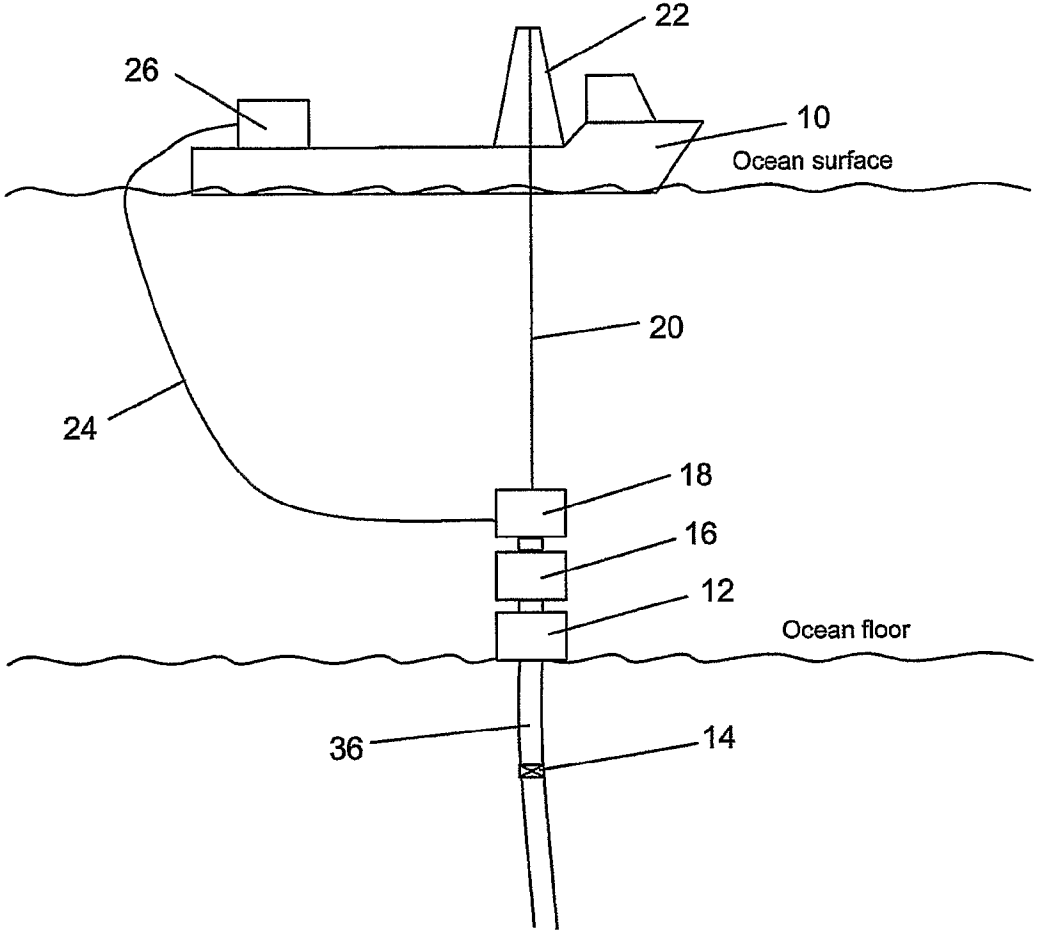
FIG. 1 shows an embodiment of the present invention in connection with drilling operations in subsea based wells with a drill pipe.

Configuration 1: System for drilling operations in subsea based wells with a drill pipe, from a vessel or device without the use of a riser. The system refers to FIG. 1. The system is comprised of a surface vessel 10 or a device/rig that is placed above the relevant subsea installation and a X-mas tree 12. In a drilling hole/production pipe 36, one can install a collectable and regulated/controlled intervention valve 14 for sluicing-in purposes. The intervention valve 14 is a testable, temporary barrier that can be opened to drive through tools for use in the well. The intervention valve can remain until the well task has been completed and can withstand impacts from falling tools, and also can be opened and be closed many times. On top of the X-mas tree (Xmas tree) of the well is placed a multifunction well blowout preventer (BOP) 16, which can include slipping, holding and cutting/sealing functions, and also functions for circulation of fluids. A drilling fluid return system 18 is placed on the top of the multifunction well blowout preventer 16. The drill pipe 20 runs into the well through open sea, and is controlled and handled at the surface with the help of dedicated systems 22. The supply and return of the drilling fluid can be handled with the help of a dedicated system 26 placed on the vessel 10 or the rig. A flexible return line 24 can connect the underwater drilling fluid system with a dedicated surface system.

A method for drilling operations in subsea based wells with a drill pipe, from a vessel or device, without the use of a riser. The method refers to FIG. 1. Before drilling commences, the well must be killed with a suitable killing fluid that is pumped into the well. When the wellhead pressure has been established at the same pressure as the surrounding pressure, and the well verified to be without pressure and stable in relation to the surrounding pressure (dead), one can lower the drill pipe 20 with the necessary downhole tools into the well through the temporary equipment for intervention, i.e. the intervention equipment, (with use of intervention valve 14, this must be opened first). The drilling fluid return system 18 will take care of the pressure control during the drilling operation, and also transport drilling fluid to the surface vessel 10 or device/rig. In connection with completion, the drilling fluid return system 18 is driven to the well for exchange of drilling fluid to diesel or a similar fluid that does not maintain control of the well pressure. A safety valve that shuts-off the system at, for example, 5 bar, can be fitted between vessel and return system for drilling fluid. The method can also be used for under balance drilling. The well will then not be without pressure, but have a small overpressure in the well in relation to the surrounding pressure at the drilling fluid return system 18. The drilling fluid return system 18 will then have a pressure control function built in for control of the pressure difference, and also that the intervention valve 14 will be used.

Figure 2:
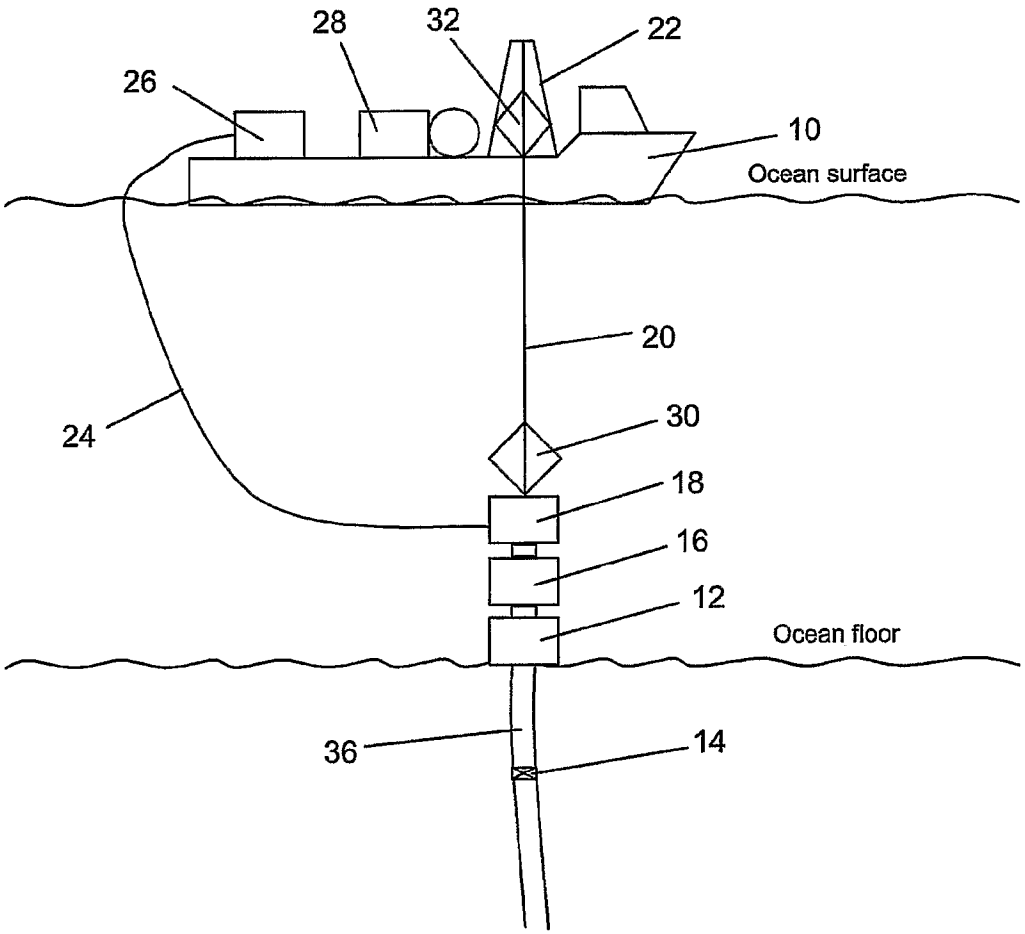
FIG. 2 shows an embodiment of the present system in connection with drilling operations in subsea based wells with a coiled tubing.

Configuration 2: System for drilling operations with coiled tubings in subsea based wells from a vessel or a device without the use of a riser. The system refers to FIG. 2. The system is comprised of a surface vessel 10 or device/rig which is localised above the relevant subsea installation and X-mas tree 12. In the production pipe 36, one can install a collectable and regulated/controlled intervention valve 14 for sluicing in purposes. The intervention valve 14 is a testable, temporary barrier that can be opened to drive through tools for use in the well. The intervention valve 14 preferably remains until the well task has been completed, can withstand impacts from falling tools and can also be opened and closed many times. On top of the X-mas tree (Xmas tree) of the well is placed a multifunction well blowout preventer (BOP) 16 that can include slipping, holding and cutting/sealing functions, and also functions for circulation of fluids. The drilling fluid return system 18 is preferably placed on the top of the multifunction well blowout preventer 16. The coiled tubing 20 runs into the well through open sea and is controlled and handled on the surface with the help of a dedicated handling system 22, coiled tubing unit 28 and surface coiled tubing injector 32 or with the help of other dedicated systems and methods for handling. An underwater coiled tubing injector head 30 is placed on top of the drilling fluid return system 18. This head can alternatively be left out with the use of well tractor technology. The supply and return of drilling fluid can be handled with the help of a dedicated system 26 placed on the vessel 10 or the device/rig.

Method for drilling operations with coiled tubings in subsea based wells, from a vessel or a device without the use of a riser. The method refers to FIG. 2. Before drilling, the well must be killed with a suitable killing fluid that is pumped into the well. When the wellhead pressure has been established at the same pressure as the surrounding pressure, i.e. the well has been verified as being without pressure and stable in relation to the surrounding pressure (dead), one can lower down the coiled tubing 20 with the necessary downhole tools in the well through the intervention equipment (with the use of intervention valve 14, this must be opened first). The drilling fluid return system 18 will preferably take care of the pressure control during the drilling operation, and also transport cuttings to the surface vessel 10 or the device/rig. An underwater coiled tubing injector 30 or a well tractor is used during drilling to provide the necessary force to the drilling tool. The coiled tubing injector on the surface 32 is used to pull the coiled pipe up from the underwater injector head 30, possibly to pull the coiled tubing with well tractor and drilling tool out of the well. The method can also be used for under balance drilling. The well must then not be without pressure, but have a small overpressure in the well in relation to the surrounding pressure at the drilling fluid return system 18. The drilling fluid return system 18 will then have a pressure control function built in, for control of the pressure difference, and also that the intervention valve 14 will be used.

Figure 3:
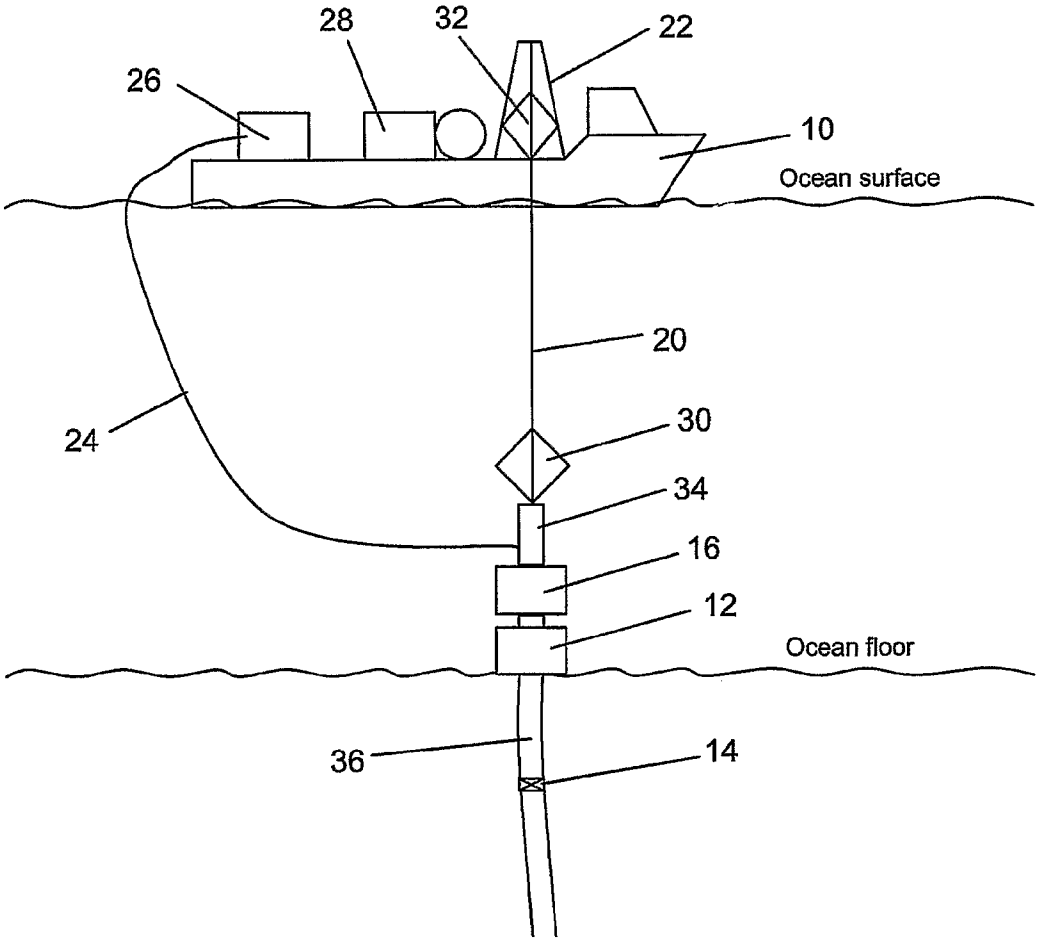
FIG. 3 shows an embodiment of the present system in connection with coiled tubing operations or wireline operations in subsea based wells.

Configuration 3: System for coiled tubing operations from a vessel or device in water- and hydrocarbon producing subsea based wells. The system refers to FIG. 3. The system is comprised of a surface vessel 10 or device/rig which is localised above the relevant subsea installation and X-mas tree 12. In the production pipe 36, one can install a collectable and regulated/controlled intervention valve 14 for sluicing-in purposes. The intervention valve is a testable, temporary barrier that can be opened to drive through tools for use in the well. The intervention valve 14 preferably remains until the well task has been completed, can withstand impacts from falling tools, and can also be opened and closed many times. On top of the X-mas tree (Xmas tree) of the well is preferably placed a multifunction well blowout preventer (BOP) 16 that can include slipping, holding and cutting/sealing functions and also functions for circulation of fluids. On the top of the multifunction well blowout preventer 16 is preferably placed one or more sluice pipes 34 with a seal between coiled tubing 20 and well pressure being mounted in the top. The coiled tubing 20 runs into the well through open sea and is controlled and handled on the surface with the help of dedicated handling systems 22, coiled tubing unit 28 and surface coiled tubing injector 32 or with the help of other dedicated systems and methods for handling. An underwater coiled tubing injector head 30 is placed on top of the sluice pipe 34 and seal. This head can alternatively be left out when well tractor or other new technology is used. Any return of well fluid or stimulation of the well can be handled with the help of a dedicated system 26 placed on the vessel 10 or the device/rig, via a hose or umbilical 24.

Method for coiled tubing operations from a vessel or device in water- and hydrocarbon producing subsea based wells. The method refers to FIG. 3. Before intervention with coiled tubing 20 can start, a collectable regulated/controlled intervention valve 14 for sluicing-in purposes must be installed. The valve must be installed at a depth that satisfies the requirements for length of well tools plus any length for stand-by operation tools (fishing). By installing the intervention valve in the production pipe 36, one does not have to build the intervention equipment in the height above the blowout valves 16 and thereby saves handling time and demands for lubricator length. The valve is tested and verified as a temporary well barrier. Hydrocarbons are flushed out of the intervention equipment, i.e. the temporary equipment used for the intervention, before a coiled tubing with tools is driven through open sea and is entered into the intervention equipment. Thereafter, the equipment is installed and tested before the well is opened and the coiled tubing is driven into the well to carry out the downhole operation.

For example, during the intervention underwater coiled tubing injector 32 or well tractor is used to provide the necessary power to the tool. The coiled tubing injector 32 on the surface can be used to pull the coiled tubing 20 up from the underwater injector head 30, possibly to pull the coiled tubing with well tractor and tool out of the well. The method can also use other, new methods for driving the coiled tubing (swift). A hosepipe 24 can be connected to the intervention equipment for any return of fluid from the well. After the downhole operation has been completed, the coiled tubing 20 is pulled out of the well until it is above the temporary, controlled intervention valve 14. Thereafter, the valve 14 is closed, necessary tests are carried out and the hydrocarbons are flushed out of the area and the equipment above the intervention valve before one can bring up the intervention tool and coiled tubing. The sequence is repeated as many times as necessary to achieve the purpose of the intervention.

Configuration 4: System for wireline work operations from a vessel or device in water- and hydrocarbon producing subsea based wells. The system refers to FIG. 3. The system is comprised of a surface vessel 10 or device/rig which is localised above the relevant subsea installation and X-mas tree 12. In the production pipe 36, one installs a collectable and regulated/controlled intervention valve 14 for sluicing-in purposes. The intervention valve 14 is a testable, temporary barrier that can be opened to drive through tools for use in the well. The intervention valve 14 preferably remains until the well task has been completed, can withstand impacts from falling tools and can also be opened and closed many times. On top of the X-mas tree (Xmas tree) of the well, is preferably placed a multifunction well blowout preventer (BOP) 16 that can include slipping, holding and cutting/sealing functions, and also functions for circulation of fluids. On top of the multifunction well blowout preventer 16 is preferably placed one or more sluice pipes 34 with a seal between wireline 20 and well pressure being mounted at the top. The wireline 20 runs into the well through open sea and is controlled and handled at the surface with the help of dedicated handling systems 22, wireline unit/winch 28 and possibly surface cable injector 32 or other surface handling for new types of cables for use in wells. An underwater cable injector 30 or other underwater systems for new cable types can be placed on the top of the sluice pipe 34 and seal. This head can alternatively be left out when a well tractor or other new technology, which can push the wireline 20 and the tool string into the well, is used. Any return of well fluid or stimulation of the well can be handled with the help of a dedicated system 26 placed on the vessel or the device, via a hose and/or umbilical 24.

Method for wireline work operations from a vessel or device in water- and hydrocarbon producing subsea based wells. The method also refers to FIG. 3. The method covers work with known conventional cable types, both braided wire with and without an electrical conductor (braided wire), and also smooth wire of metal (slickline). In addition, work with newly developed cable technology based on composite materials, thermoplastics and metals are covered. Before intervention with wireline 20 can start, a collectable, regulated/controlled intervention valve 14 for sluicing-in purposes must be installed. The valve 14 is installed at a depth that satisfies the requirements for length of well tools, well tractor, plus any length for standby operation tools (fishing). By installing the intervention valve in the production pipe 36, one does not have to build the intervention equipment in the height above the blowout valves 16 and thereby saves handling time and demands for lubricator length above the permanent X-mas tree 12. The valve is tested and verified as a temporary well barrier. Hydrocarbons are flushed out of the intervention equipment before wireline 20 with tools and any well tractor is driven through open sea and is entered into the intervention equipment. Thereafter, the equipment is installed and tested before the well is opened and the tool can be driven into the well to carry out the downhole operation. During intervention, the tool string and any well tractor are lowered with the help of a cable winch at the surface. When the deviation in the well becomes so large that the tool does not go in any further, the well tractor is connected. The well tractor will push the tool and pull the cable until the required depth has been reached.

With the use of new cable types, a combination of underwater and surface cable injectors 30,32, other injection systems for new cable types or well tractor can be employed to provide the necessary force to the tool to carry out the well task. The cable injector 32 or other surface handling of new cable types, is used to pull the wireline 20 up from the underwater injector head 30, and possibly to pull the cable with well tractor and tool out of the well.

After the downhole operation has been completed, the wireline 20 is pulled out of the well until it is above the temporary, regulated/controlled intervention valve 14. Thereafter the valve 14 is closed and the necessary tests are carried out and the hydrocarbons are flushed out of the area and equipment above the intervention valve, before one can bring up the intervention tool and wireline. The sequence is repeated as many times as necessary to achieve the intervention purpose. A hose 24 can be connected to the intervention equipment for any return of fluid, stimulation or inhibition of the well.

It shall be noted that in an alternative embodiment, use of the intervention valve can also be employed on appliances that have X-mas trees located on board (dry trees).

The FIGS. 4*a* to 4*c* show an example of an intervention valve 14 that can be used in the present invention, but it must be understood that also other valve types can be used. The valve can, in the main, be put together from known components.

As shown, the valve 14 can be mechanically fastened to the wall of the production pipe 36 with the help of conventional "anchors" 42, and a hydraulic seal can be achieved with the help of known elastomer technology, for example, an elastomer seal 44. An anchor and elastomer seal 42, 44 can be activated with the help of a combined placing-pulling-charging-tool on the wireline. A flapper valve 46 can be placed in the bottom of the valve 14, for example, similar to those used in permanent downhole safety valves, which are activated by driving one or more casings 47 back or forth. At the top, a safety net 48, in the form of, for example, an inversed flapper, so called tool trap, can be placed, that is also activated by driving a casing back or forth.

The valve can have the following components built in: Battery pack 50, electronics 52 for communication and control and electro hydraulic pack 54 for opening and closing the valve. Signal transmission to the electronics in the valve 14 can be transmitted with the help of one of more wireless systems, either via the steel in the completion, or the medium/fluid in the well.

An example of the main characteristics, systems and functions of a valve, can be a valve in relation to the following specifications:

10 kpsi 150° C. design

Pressure, temperature and capacity sensors

Surface monitoring and control systems
Communicates with the subsea control system with the help of wireless transmission
Chargeable in situ battery pack built in
Electro-hydraulic system for valve activation
Safety net
Redundancy of all critical units and systems
Multifunctional placing, pulling and charging tool As mentioned, other valves can, of course, be used that meet the requirements which the present system poses, and the invention is therefore not limited to the embodiment example shown. Furthermore, it shall be pointed out that use of the intervention valve can also be employed on appliances that have X-mas trees located on board (dry trees).

The invention claimed is:

1. A system for well intervention in subsea installed water- or hydrocarbon producing wells, comprising a surface vessel with equipment for handling and control of a connection string for downhole tools;

a system for the supply and return of drilling fluid, from which the connection string runs down into a drilling hole on the subsea through open sea without a riser or landing string being fitted a X-mas tree, being arranged on the well;

a blowout preventer wherein the blowout preventer is associated with the X-mas tree, the blowout preventer, being arranged on the well;

a drilling fluid return system in combination with complementary valves to control well pressure and well fluid, said drilling fluid return system being placed on top of the blowout preventer through which the connection string is led;

a return line for drilling fluid wherein the return line runs from the drilling fluid return system to the system for supply and return of drilling fluid; and a collectable intervention valve, wherein the intervention valve is anchored in the drilling hole and wherein the intervention valve is arranged to function as a testable, temporary barrier, wherein the valve comprises elastomer seals and means for closing the bottom and top of the intervention valve, in order to shut off the well and to be opened to drive through downhole tools in the well, and wherein the intervention valve is wireless remotely operated.

2. The system of claim 1, wherein the intervention valve is a controlled or regulated valve for sluicing-in purposes.

3. The system of claim 2, further comprising a sluice device for coiled tubing, drillpipe, or wireline operations in water- and hydrocarbon producing wells, wherein the sluice device comprises at least one sluice pipe with a seal between coiled tubing or wireline, arranged on the top of the blowout preventer, through which the connection string for the downhole tool is led, and the return line runs from the sluice device to the system for supply and any return of fluid.

4. The system of claim 3, wherein the surface vessel comprises a coiled tubing, drilling or wireline unit, or a coiled tubing injector or cable injector.

5. The system of claim 3, wherein the sluice device is fitted to a coiled tubing injector or cable injector.

6. The system of claim 5, wherein the surface vessel, comprises a coiled tubing, drilling or wireline unit, or a coiled tubing injector or cable injector.

7. A method for well intervention in subsea installed water- or hydrocarbon producing wells, comprising leading a connection string for an intervention valve from a surface vessel through open sea without a riser or landing string being fitted, down to an actual well on the subsea, wherein the connection string is handled and controlled with the help of equipment on the surface vessel and wherein the well comprises a drilling hole;

providing a system to supply and return drilling fluid, wherein the system is on the surface vessel, and wherein a return line for drilling fluid runs up to said system;

providing a X-mas tree, being arranged on the well, with a blowout preventer, the blowout preventer being associated with the X-mas tree, the blowout preventer being arranged on the well;

providing a drilling fluid return system in combination with complementary valves to control well pressure and well fluid, said drilling fluid return system is being placed on top of the blowout preventer, through which the connection string is led;

closing the drilling hole, before the connection string is led into the well;

installing the intervention valve as a collectable, wireless remotely operated intervention valve in the drilling hole, wherein the intervention valve is a testable, temporary barrier for using the drilling hole as a sluice for the downhole tool that shall go into the well, said intervention valve being installed at a depth in the drilling hole such that the depth meets the requirements for length of well tools and any length for recovery operation tools;

testing the intervention valve to verify that the intervention valve is a temporary well barrier before opening the intervention valve to let through downhole tools; and opening the intervention valve to let through a second connection string with the downhole tool that shall be used in the well.

8. The method of claim 7, further comprising:

killing the well with a suitable killing fluid that is pumped into the well when the wellhead pressure has been established at the same pressure as the surrounding pressure;

verifying the well as being without pressure and stable in relation to the surrounding pressure;

lowering the drill pipe or coiled tubing with necessary downhole tools down into the well, wherein the drilling fluid return system takes care of the pressure control during the drilling operation, and transports drilling fluid and cuttings to the surface vessel.

9. The method according to claim 8, wherein the drilling fluid return system is driven to the well for replacement of drilling fluid to diesel or similar fluid that does not keep control of the well pressure, and further wherein a safety valve which closes the system is fitted between vessel and return system for drilling fluid.

10. The method of claim 9, wherein an underwater coiled tubing injector or well tractor is used to provide sufficient power to the drilling tool, and wherein a coiled tubing injector at the surface is used to pull the coiled tubing up from an underwater coiled tubing injector head.

11. The method of claim 10, further comprising pulling the coiled tubing out of the well after the downhole operation has been completed to a position above the temporary intervention valve;

closing the intervention valve;

performing tests and flushing hydrocarbons out of the area and equipment above the valve, before intervention tools and the coiled tubing are brought up;

repeating the sequence as many times as necessary to achieved the purpose of the intervention.

12. The method of claim 8, wherein an underwater coiled tubing injector or well tractor is used to provide sufficient power to the drilling tool, and wherein a coiled tubing injector at the surface is used to pull the coiled tubing up from an underwater coiled tubing injector head.

13. The method of claim 12, further comprising pulling the coiled tubing out of the well after the downhole operation has been completed to a position above the temporary intervention valve;

closing the intervention valve;

performing tests and flushing hydrocarbons out of the area and equipment above the valve, before intervention tools and the coiled tubing are brought up;

repeating the sequence as many times as necessary to achieved the purpose of the intervention.

14. The method of claim 7, further comprising:

lowering a tool string and any well tractor during the intervention with a wireline winch at the surface, and wherein when the deviation of the well is so large that the tool does not go any further, the well tractor is brought in to push the tool and to pull the cable until a required depth has been reached.

15. The method of claim 14, further comprising pulling the wireline out of the well until it is above the intervention valve closing the intervention valve when the wireline is above the intervention valve performing tests and flushing hydrocarbons out of the area and equipment above the valve, before intervention tools and the coiled tubing are brought up;

repeating the sequence as many times as necessary to achieved the purpose of the intervention.

16. The method of claim 7, further comprising pumping in inhibitory fluid with substantially higher specific gravity than the well fluids to flush or force well fluids and gas between the intervention valve and the X-mas tree of the well out of the area, at the same time as pressure is released out of the limited area as high up as possible to avoid too high pressure to flush out well fluids and gases.

17. The method of claim 16, wherein the inhibitory fluid is allowed to sink down toward the intervention valve and to replace well fluids and gases from the intervention valve, dedicated outlet in the X-mas tree, or in dedicated outlets from other parts of the temporary equipment that is used for the intervention, until all well fluids and gases are out of production pipe, whereupon the flushing and circulation system of the intervention system carries out the remaining flushing out.

* * * * *